US010363950B2

(12) United States Patent
Worthey, Sr.

(10) Patent No.: US 10,363,950 B2
(45) Date of Patent: Jul. 30, 2019

(54) SYSTEM FOR DETECTING OBSTRUCTIONS ON A RAILROAD CROSSING

(71) Applicant: Anthony Charles Worthey, Sr., Stafford, VA (US)

(72) Inventor: Anthony Charles Worthey, Sr., Stafford, VA (US)

(73) Assignee: Anthony C. Worthey, Lancaster, OH (US)

( * ) Notice: Subject to any disclaimer, the term of this patent is extended or adjusted under 35 U.S.C. 154(b) by 320 days.

(21) Appl. No.: 15/468,692

(22) Filed: Mar. 24, 2017

(65) Prior Publication Data

US 2017/0274917 A1 Sep. 28, 2017

Related U.S. Application Data

(60) Provisional application No. 62/312,929, filed on Mar. 24, 2016.

(51) Int. Cl.
*B61L 29/30* (2006.01)
*B61L 23/04* (2006.01)

(52) U.S. Cl.
CPC ..... *B61L 29/30* (2013.01); *B61L 23/041* (2013.01)

(58) Field of Classification Search
CPC ..... B61L 23/041; B61L 29/30; B61L 29/00; B61L 29/04; B61L 29/08; B61L 29/32; B61L 23/14; B61L 23/04
See application file for complete search history.

(56) References Cited

U.S. PATENT DOCUMENTS 5,787,369 A * 7/1998 Knaak ..... B61L 23/041 340/435
6,195,020 B1 * 2/2001 Brodeur, Sr. ..... B61L 29/22 246/125
6,340,139 B1 * 1/2002 Hilleary ..... B61L 29/08 246/125
7,075,427 B1 * 7/2006 Pace ..... B61L 23/06 246/125
7,715,276 B2 * 5/2010 Agam ..... B61L 23/041 367/96
7,832,691 B2 * 11/2010 Reibeling ..... B61L 29/32 246/113
8,596,587 B2 * 12/2013 Hilleary ..... B61L 23/041 246/125
2002/0185571 A1 * 12/2002 Bryant ..... B61L 29/08 246/125
2008/0136632 A1 * 6/2008 Pieralli ..... B61L 29/30 340/552
2016/0200334 A1 * 7/2016 Hilleary ..... G08G 1/097 246/218

* cited by examiner

*Primary Examiner* — Mark T Le

(57) ABSTRACT

A system for detecting obstructions within a railroad crossing. The system may include at least one housing in the form of a tower. The housing is located at the railroad crossing. A sensor box may be disposed within the housing. The sensor box may include a sensor and a transmitter disposed within. The sensor is operable to detect an obstruction on a railroad at the railroad crossing. The present invention further includes a wiring electrically connecting the sensor box to a signal gate at the railroad crossing. When the signal gate is powered the sensor is powered and the wireless transmitter is operable to transmit a signal to an oncoming train when the sensor detects the obstruction on the railroad.

10 Claims, 3 Drawing Sheets

SYSTEM FOR DETECTING OBSTRUCTIONS ON A RAILROAD CROSSING

CROSS-REFERENCE TO RELATED APPLICATION

This application claims the benefit of priority of U.S. provisional application No. 62/312,929, filed Mar. 24, 2016, the contents of which are herein incorporated by reference.

BACKGROUND OF THE INVENTION

The present invention relates to railroad crossings and, more particularly, to a system for detecting obstructions on a railroad crossing.

A railroad crossing is an intersection where a railway line crosses a road or path at the same level, as opposed to the railway line crossing over or under using a bridge or tunnel. Railroad trains have a much larger mass relative to their braking capability, and thus a far longer braking distance than road vehicles. In general, trains do not stop at level crossings but rely on vehicles and pedestrians to clear the tracks in advance. Railroad crossings constitute a significant safety concern. On average, each year 300 people are killed in the United States in railroad crossing accidents. Collisions can occur with vehicles as well as pedestrians. Current trains are unable to detect an obstruction of the railroad crossing at a distance that allows the train to make a complete stop prior to a collision.

As can be seen, there is a need for a system for detecting obstructions on a railroad crossing.

SUMMARY OF THE INVENTION

In one aspect of the present invention, a system for detecting obstructions within a railroad crossing comprises: at least one housing disposed at the railroad crossing; a sensor disposed within the housing and operable to detect an obstruction on a railroad at the railroad crossing; a wiring electrically connecting the sensor to a signal gate at the railroad crossing, wherein when the signal gate is powered the sensor is powered; and a wireless transmitter operable to transmit a signal to an oncoming train when the sensor detects the obstruction on the railroad.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes a closed-circuit infrared sensor with an adjustable timing threshold that when connected to a Positive Train Control (PTC) commuter train global position system, will deploy automated braking of trains approaching a crossing if an obstruction is detected. By alerting the train/operator of obstruction in the crossing before they can even see it, it gives the train a signal to slow down and stop to avoid or lessen the collision impact.

The train creates a shunt by the friction caused traveling across the electrical line and initiating the gate warning system. When the gate falls, it turns on the sensors. The sensor timing is dependent on each crossing but when the time has passed that is allotted, the sensor triggers the automated braking system for the train (PTC) system. The present invention alerts the train and the operator, which then slows down and/or stops the train before arriving to the crossing. The train operator has the ability to override the train braking system once they visually verify a clear crossing. The system includes an auxiliary battery backup so when the power is out, the sensor will be able to be used.

Figure 1:
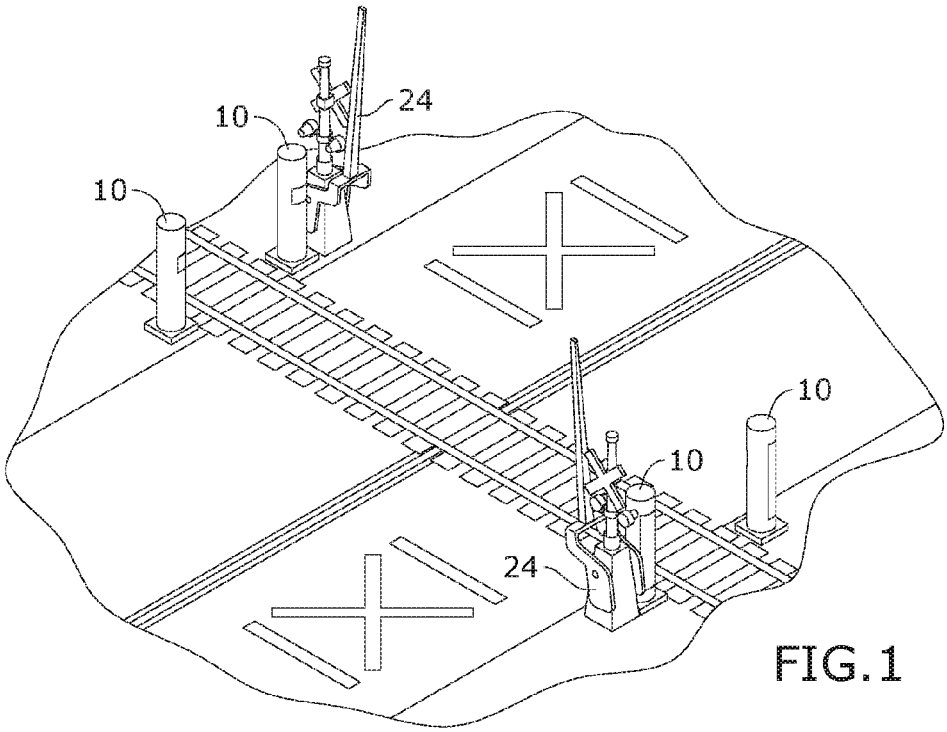
FIG. 1 is a perspective schematic view of an embodiment of the present invention.
Figure 2:
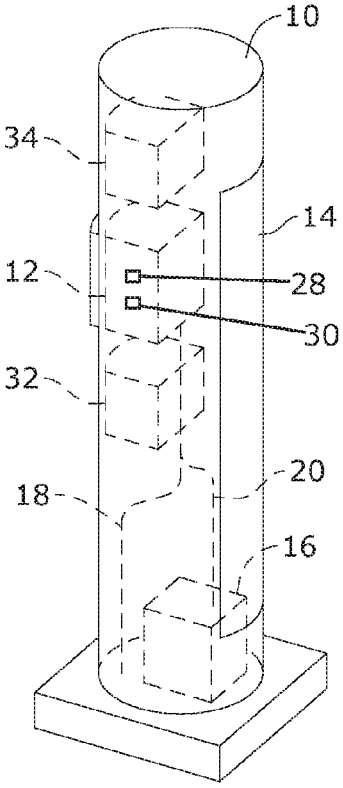
FIG. 2 is a schematic view of a housing of the present invention.
Figure 3:
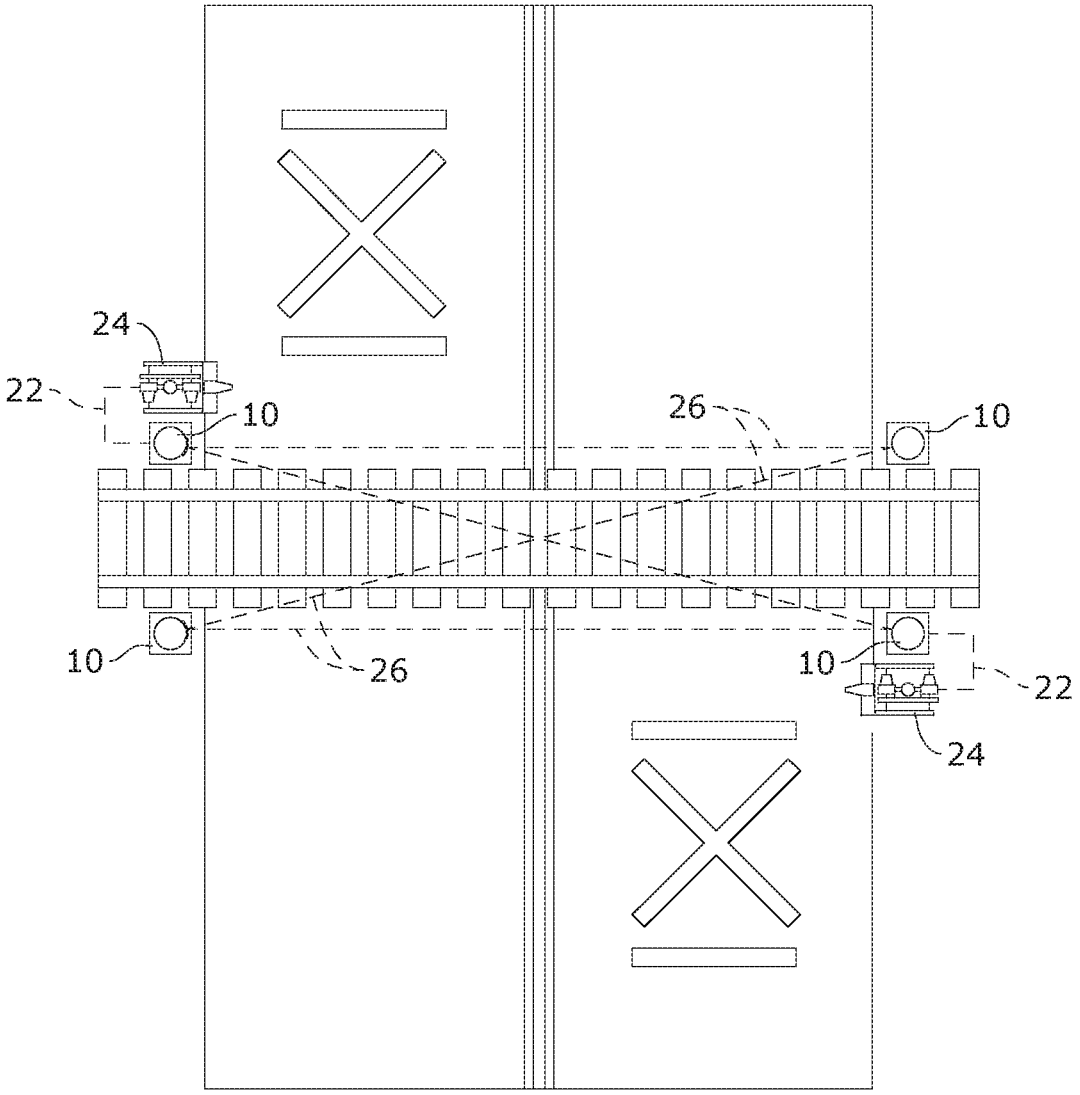
FIG. 3 is a top schematic view of an embodiment of the present invention.
Figure 4:
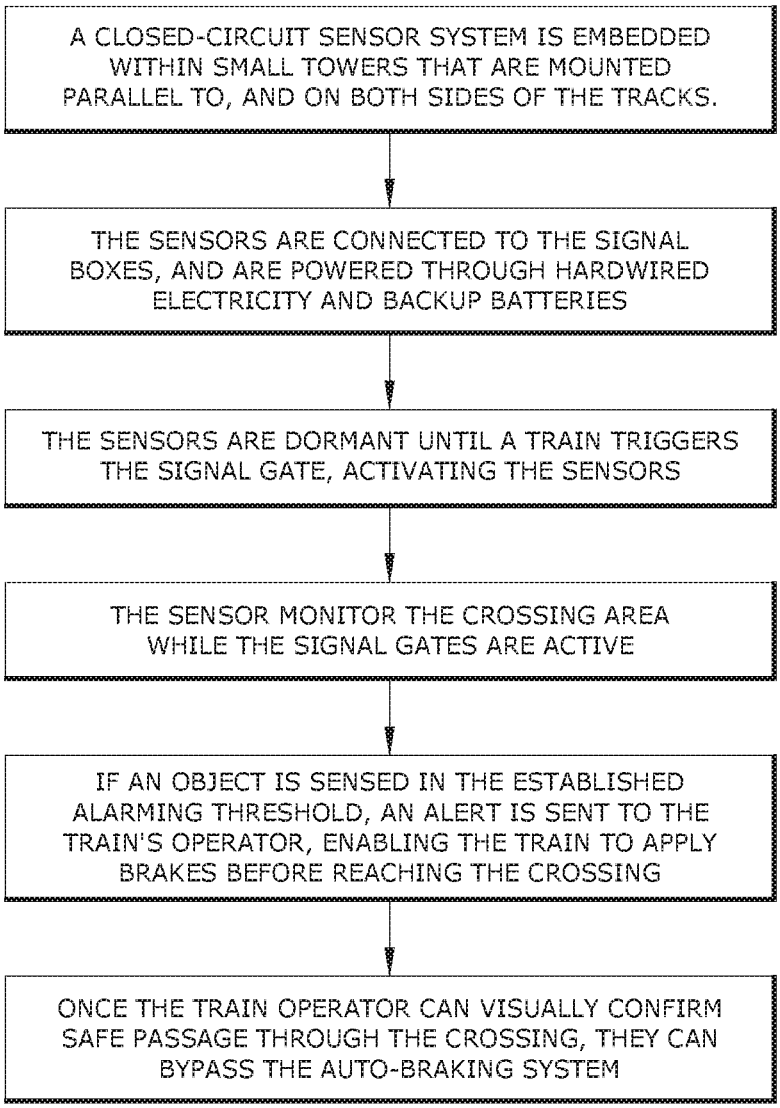
FIG. 4 is a flow chart of method steps of an embodiment of the present invention.

Referring to FIGS. 1 through 4, the present invention includes a system for detecting obstructions on a railroad crossing. The system may include at least one housing 10 in the form of a tower. The housing 10 is located at the railroad crossing. A sensor box 12 may be disposed within the housing 10. The sensor box 12 may include a sensor 28 and a transmitter 30 disposed within. The sensor 28 is operable to detect an obstruction on a railroad at the railroad crossing. The present invention further includes a wiring 22 electrically connecting the sensor box 12 to a signal gate 24 at the railroad crossing. When the signal gate 24 is powered the sensor is powered and the wireless transmitter is operable to transmit a signal to an oncoming train when the sensor detects the obstruction on the railroad.

The present invention may further include a timer 32. The timer 32 may include a programmable countdown. The timer 32 may be disposed within the sensor box 12 and may be electrically connected to the sensor 28. When the sensor 28 detects the obstruction the countdown begins and if the sensor 28 maintains detection of the obstruction by an end of the countdown, the wireless transmitter 30 transmits the signal. If the obstruction is moved before the countdown has ended, the signal 28 is not transmitted from the wireless transmitter 30.

Currently, trains include positive train control. Positive train control (PTC) is a system of functional requirements for monitoring and controlling train movements as an attempt to provide increased safety. The main concept in PTC is that the train receives information about its location and where it is allowed to safely travel, also known as movement authorities. Equipment on board the train then enforces this, preventing unsafe movement. PTC systems may work in either dark territory or signaled territory, and may use satellite global position system (GPS) navigation to track train movements. The transmitter 30 transmits the signal to the positive train control of the train which activates a braking system of the train. In certain embodiments, the positive train control includes a manual bypass operable to turn off the braking system. Therefore, if the conductor approaches the railroad crossing and sees there is no obstruction, the conductor may manually bypass the braking system and continue traveling through the railroad crossing.

In certain embodiments, the present invention includes a plurality of housings 10 disposed at the railroad crossing.

The plurality of housings 10 include a first housing 10 disposed at a first side of the railroad and a first side of a street, a second housing 10 disposed at a second side of the railroad and the first side of the street, a third housing 10 disposed at the first side of the railroad and the second side of the street and a fourth housing 10 disposed at the second side of the railroad and the second side of the street. The sensors 28 may include infrared sensors 28. The infrared sensors 28 produce lasers 26 sent between the housings 10. If the path of the laser 26 between the housings 10 is broken, the obstruction is detected. A laser 26 may be sent between the first housing 10 and the third housing 10, between the second housing 10 and the fourth housing 10, between the first housing 10 and the fourth housing 10 and between the second housing 10 and the third housing 10. Therefore, the infrared sensors 28 are operable to detect an obstruction between the first housing 10 and the third housing 10, between the second housing 10 and the fourth housing 10, between the first housing 10 and the fourth housing 10 and between the second housing 10 and the third housing 10.

At least one of the housings 10 may further include a camera 34. Once the obstruction is sensed by the sensors 28 and the countdown has completed, the camera 34 may take a digital picture. The transmitter 30 may transmit a digital picture of the obstruction to an onboard computer on the train. Therefore, the conductor of the train may view the digital picture to see what is obstructing the railroad crossing.

As mentioned above, the housing 10 may be in the form of a tower. The sensor box 12 may be disposed at a top portion of the housing 10. The sensor box 12 of the present invention may be hard wired 18 to the electrical grid. However, in case the power of the electrical grid goes out, each of the housings 10 may include a backup battery 16. The backup battery 16 may be electrically connected to the sensor box 12 by a battery wiring 20. The housing 10 may further include an access panel 14 to access the sensor box 12 and the backup battery 16.

A method of making the present invention may include the following. Create and mount a grade level mount at precision height (dependent on each crossing) where electricity and auxiliary power can be connected to a crossing gate mechanism. The tower may be about 13 inches round, about 41-43 inches tall above ground and about 24 inches below ground, made of galvanized weather tight aluminum steel. The sensor and the auxiliary battery is mounted on the inside of the tower. The closed circuit system further includes a transmitter and a receiver. In alternate embodiments, the components of the present invention may be mounted in the gate mechanism itself.

It should be understood, of course, that the foregoing relates to exemplary embodiments of the invention and that modifications may be made without departing from the spirit and scope of the invention as set forth in the following claims.

What is claimed is:

1. A system for detecting obstructions within a railroad crossing comprising:

at least one housing disposed at the railroad crossing;

a sensor disposed within the housing and operable to detect an obstruction on a railroad at the railroad crossing;

a wiring electrically connecting the sensor to a signal gate at the railroad crossing, wherein when the signal gate is powered the sensor is powered; and a wireless transmitter operable to transmit a signal to an oncoming train when the sensor detects the obstruction on the railroad.

2. The system of claim 1, further comprising a timer comprising a countdown, wherein when the sensor detects the obstruction the countdown begins and if the sensor maintains detection of the obstruction by an end of the countdown, the wireless transmitter transmits the signal.

3. The system of claim 1, wherein the at least one housing comprises a plurality of housings disposed at the railroad crossing.

4. The system of claim 1, wherein the plurality of housings comprises a first housing disposed at a first side of the railroad and a first side of a street, a second housing disposed at a second side of the railroad and the first side of the street, a third housing disposed at the first side of the railroad and the second side of the street and a fourth housing disposed at the second side of the railroad and the second side of the street.

5. The system of claim 4, wherein the sensors are infrared sensors.

6. The system of claim 5, wherein the infrared sensors are operable to detect an obstruction between the first housing and the third housing, between the second housing and the fourth housing, between the first housing and the fourth housing and between the second housing and the third housing.

7. The system of claim 1, wherein the transmitter transmits the signal to a positive train control of the train activating a braking system of the train.

8. The system of claim 7, wherein the positive train control comprises a manual bypass operable to turn off the braking system.

9. The system of claim 1, further comprising a backup battery disposed within the housing and electrically connected to the sensor and the wireless transmitter.

10. The system of claim 1, further comprising a camera operable to take a picture of the railroad crossing when the sensor senses an obstruction, wherein the picture is transmitted to the oncoming train by the wireless transmitter.

* * * * *